US007891650B2

(12) United States Patent
Förch et al.

(10) Patent No.: US 7,891,650 B2
(45) Date of Patent: Feb. 22, 2011

(54) METHOD AND APPARATUS FOR PROOF SHEET REMOVAL

(75) Inventors: Peter Förch, Neustadt (DE); Markus Möhringer, Weinheim (DE); Paul Nicola, Heidelberg (DE); Marius Stelter, Heidelberg (DE); Ralf Wadlinger, Hockenheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 1 day.

(21) Appl. No.: 12/044,096

(22) Filed: Mar. 7, 2008

(65) Prior Publication Data

US 2008/0217836 A1 Sep. 11, 2008

(30) Foreign Application Priority Data

Mar. 7, 2007 (DE) ..... 10 2007 011 046

(51) Int. Cl.

| | |
|---|---|
| ***B42B 2/00*** | (2006.01) |
| ***B42B 2/02*** | (2006.01) |
| ***B65H 33/04*** | (2006.01) |
| ***B65H 39/00*** | (2006.01) |

(52) U.S. Cl. ..... 270/58.01; 270/52.14; 270/52.01; 270/58.33

(58) Field of Classification Search ..... 270/52.14, 270/52.01, 58.33, 58.01; 271/280, 207
See application file for complete search history.

(56) References Cited

U.S. PATENT DOCUMENTS

| | | | | |
|---|---|---|---|---|
| 5,697,605 | A | 12/1997 | Pollich et al. | |
| 5,732,940 | A * | 3/1998 | Kobayashi et al. | 270/58.01 |
| 6,095,518 | A * | 8/2000 | Allmendinger et al. | 271/215 |
| 6,786,148 | B2 * | 9/2004 | Friedrichs et al. | 101/217 |
| 6,819,906 | B1 * | 11/2004 | Herrmann et al. | 399/368 |
| 7,048,273 | B2 * | 5/2006 | Meckes et al. | 271/258.01 |

FOREIGN PATENT DOCUMENTS

| | | | |
|---|---|---|---|
| DE | 3230436 | A1 | 6/1983 |
| DE | 4213032 | A1 | 10/1993 |
| DE | 19507370 | A1 | 9/1996 |
| DE | 19905263 | C1 | 1/2000 |
| DE | 10306493 | A1 | 10/2003 |

* cited by examiner

*Primary Examiner*—Gene Crawford
*Assistant Examiner*—Yolanda Cumbess
(74) *Attorney, Agent, or Firm*—Laurence A. Greenberg; Werner H. Stemer; Ralph E. Locher

(57) ABSTRACT

An apparatus for the removal of proof sheets from a sheet-processing machine has at least one sheet catcher provided with a gripper device. The gripper draws the sheet out of the stacking region. A lower sheet catcher is first moved into the stacking region above the sheet stack. Following a deposition of at least one proof sheet, the sheet is gripped with the gripper device, and following sheets are held back with an upper sheet catcher. Then the proof sheet is drawn out of the stacking region by moving the lower sheet catcher and the gripper device back.

11 Claims, 9 Drawing Sheets

METHOD AND APPARATUS FOR PROOF SHEET REMOVAL

CROSS-REFERENCE TO RELATED APPLICATION

This application claims the priority, under 35 U.S.C. §119, of German application DE 10 2007 011 046.6, filed Mar. 7, 2007; the prior application is herewith incorporated by reference in its entirety.

BACKGROUND OF THE INVENTION

Field of the Invention

The invention relates to a method and an apparatus for the removal of proof sheets from a sheet stack.

In order to remove proof sheets from a deposit stack during the operation of a sheet-processing machine, in particular a printing press, without impairing the formation of the stack, great skill is required of the operating personnel. In order to grip a sheet released by the grippers of the chain gripper system—so to speak in free flight—and to remove it so quickly from the deposit area that a following sheet is not hindered, requires great skill and experience.

In order to make this manual proof sheet removal easier, German published patent application DE 103 06 493 A1 discloses firstly inserting a first sheet catcher, on which one or more sheets are deposited, into the deposit region above the deposit stack. Then, a second sheet catcher is inserted into the deposit region above the first sheet catcher, on which from time to time following sheets are deposited and, following the removal of the proof sheet or of a proof sheet stack, are combined with the main stack. The sheet catchers are in each case arranged to be stationary and can be moved from a waiting position outside the sheet stack into an operating position in the region of the sheet stack.

In order to remove proof sheets, in this case an operator has to reach manually into the stacking region in order to be able to remove the proof sheet or sheets.

BRIEF SUMMARY OF THE INVENTION

It is accordingly an object of the invention to provide a a method and an apparatus which overcome the above-mentioned disadvantages of the heretofore-known devices and methods of this general type and which allows the removal of a proof sheet or a proof sheet stack from the stacking region.

With the foregoing and other objects in view there is provided, in accordance with the invention, a method of removing at least one proof sheet from a stacking region of a sheet stack in a sheet-processing machine, the method comprises:

providing a proof sheet removal system with two mutually spaced-apart sheet catchers including a lower sheet catcher and an upper sheet catcher;

moving the lower sheet catcher forward into the stacking region above the sheet stack by an actuator;

following a deposition of at least one proof sheet, fixing the proof sheet with a gripper device, and holding back following sheets by moving in the upper sheet catcher by an actuator; and drawing the at least one sheet out of the stacking region by moving the lower sheet catcher and the gripper device back.

With the above and other objects in view there is also provided, in accordance with the invention, an apparatus for removing at least one proof sheet from a stacking region of a sheet stack in a sheet-processing machine, comprising: a proof sheet removal system having two mutually spaced-apart sheet catchers; and one of the sheet catchers having a gripper device.

It is a particular advantage of the invention that the operating personnel for the removal of proof sheets can remove these from the stacking region without any danger.

In an advantageous arrangement, a sheet catcher is equipped with a gripper device. Furthermore, the sheet catchers can be lowered at the cycle rate of the sheet-processing machine or synchronously with the sheet stack. As a result of this measure, a large time window is available for the proof sheet removal.

Lateral clamping devices for the upper layers of the main stack, as retaining elements, ensure that the proof sheet or sheets can be removed without pulling the sheets already deposited from the main stack with them.

An exemplary embodiment of the invention is illustrated in the drawings and will be described in the following text.

Other features which are considered as characteristic for the invention are set forth in the appended claims.

Although the invention is illustrated and described herein as embodied in method and apparatus for proof sheet removal, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
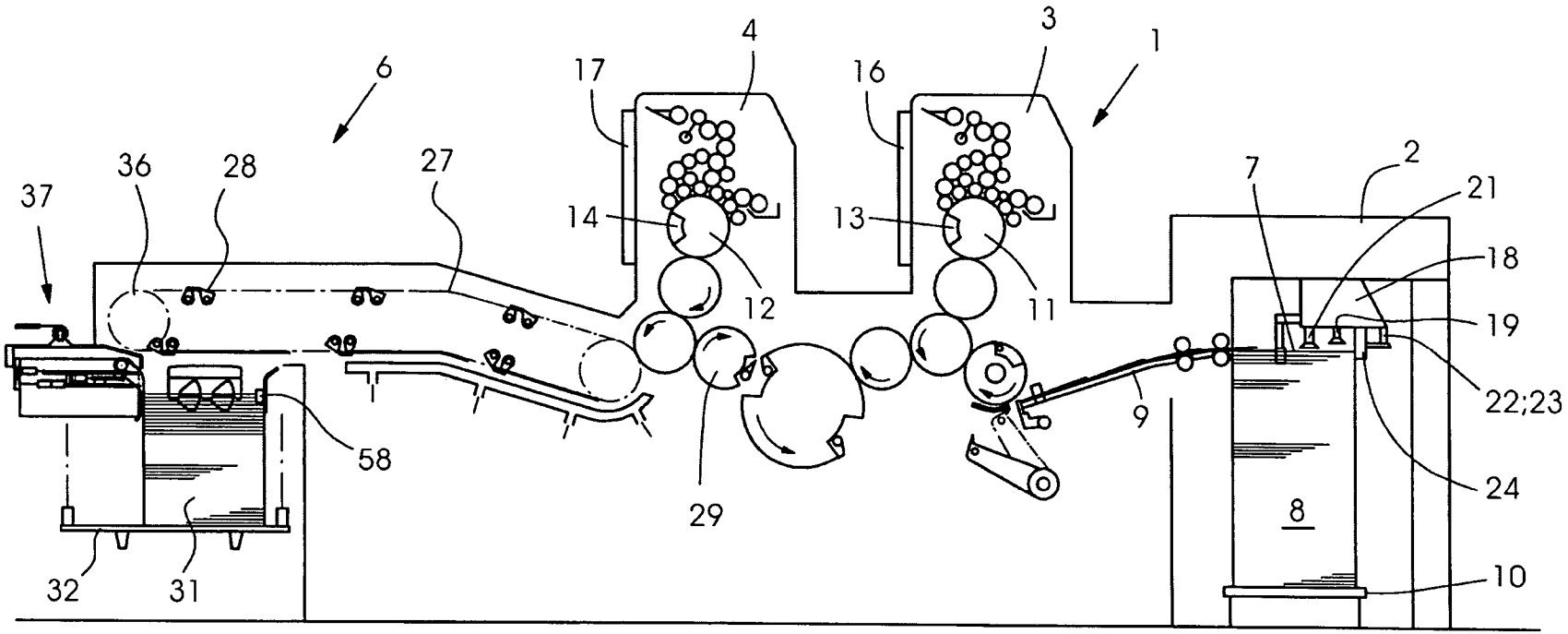
FIG. 1 is a schematic sectional illustration of a sheetfed rotary press.

Referring now to the figures of the drawing in detail and first, particularly, to FIG. 1 thereof, there is seen a sheet-processing machine 1, such as a printing press 1, with a feeder 2, at least one printing unit 3 and 4 and a delivery 6. Sheets 7 are removed from a sheet stack 8 and, separated or overlapping, are fed over a feed table 9 to the printing units 3 and 4. Each of the printing units 3, 4 contains, in a known way, a plate cylinder 11, 12. The plate cylinders 11, 12 each have a device 13, 14 for mounting flexible printing plates. Furthermore, each plate cylinder 11, 12 is assigned a device 16, 17 for fully automatic or semiautomatic printing plate exchange.

The sheet stack 8 rests on a stack board 10 that can be raised under control. The sheets 7 are removed from the top of the sheet stack 8 by means of what is known as a suction head 18 which, inter alia, has a number of lifting and dragging suckers 19, 21 for separating the sheets 7. Furthermore, blowing devices 22 for loosening the upper sheet layers and sensing elements 23 for stack tracking are provided. In order to align the sheet stack 8, in particular the upper sheets 7 of the sheet stack 8, a number of side and rear stops 24, i.e., side lays and rear lays 24, are provided.

The delivery 6 has a chain conveyor system 27 having a number of gripper bars 28. These accept the sheet 7 from the last cylinder 29 of the sheet-processing machine, for example the printing press 1, and transport it onto a sheet delivery stack 31. The delivery stack 31 is arranged on a stack board 32, which can be raised and lowered at the cycle rate of the sheet-processing machine by means of a raising and lowering apparatus, comprising motor 33, chain wheels 36 and chains 34.

Figure 2:
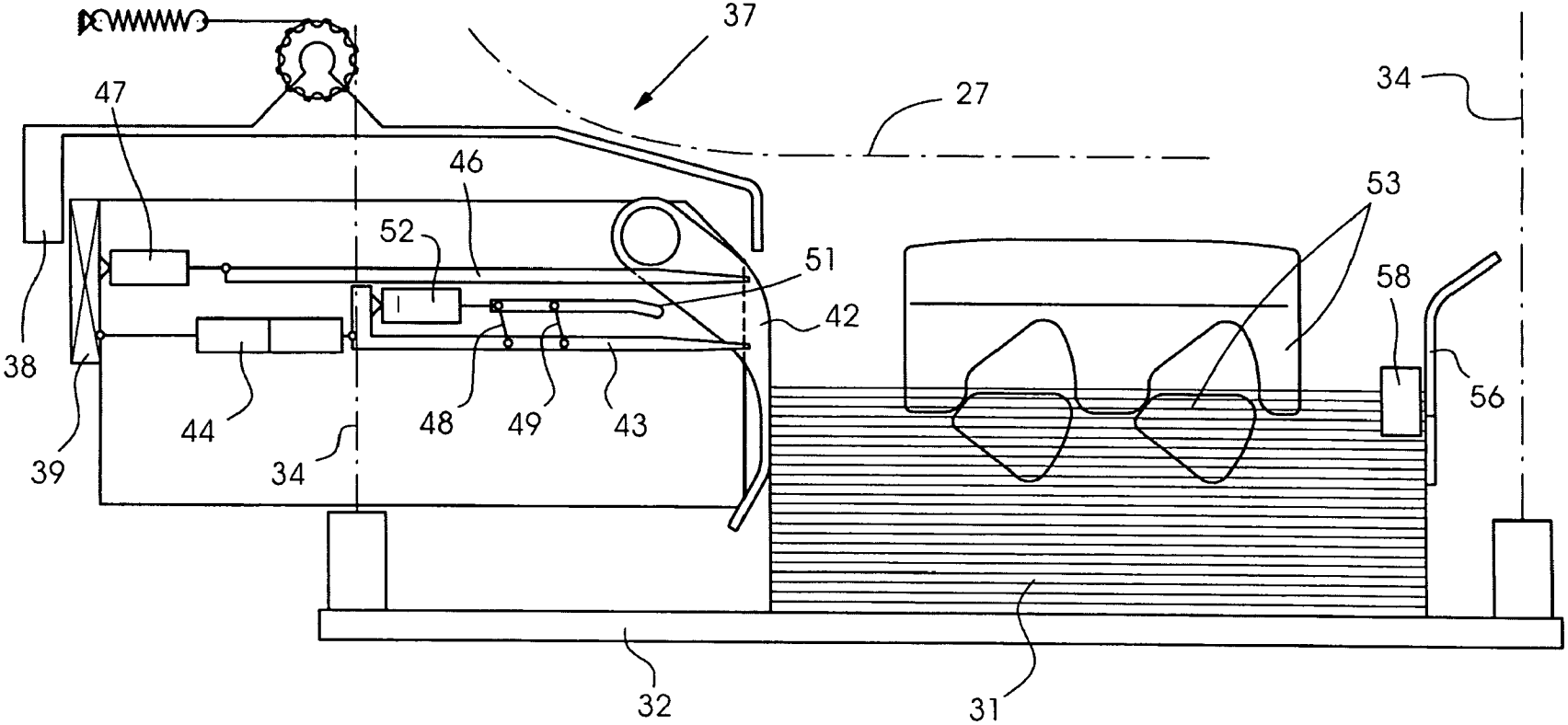
FIG. 2 is a schematic side view of an apparatus for proof sheet removal according to the invention.
Figure 3:
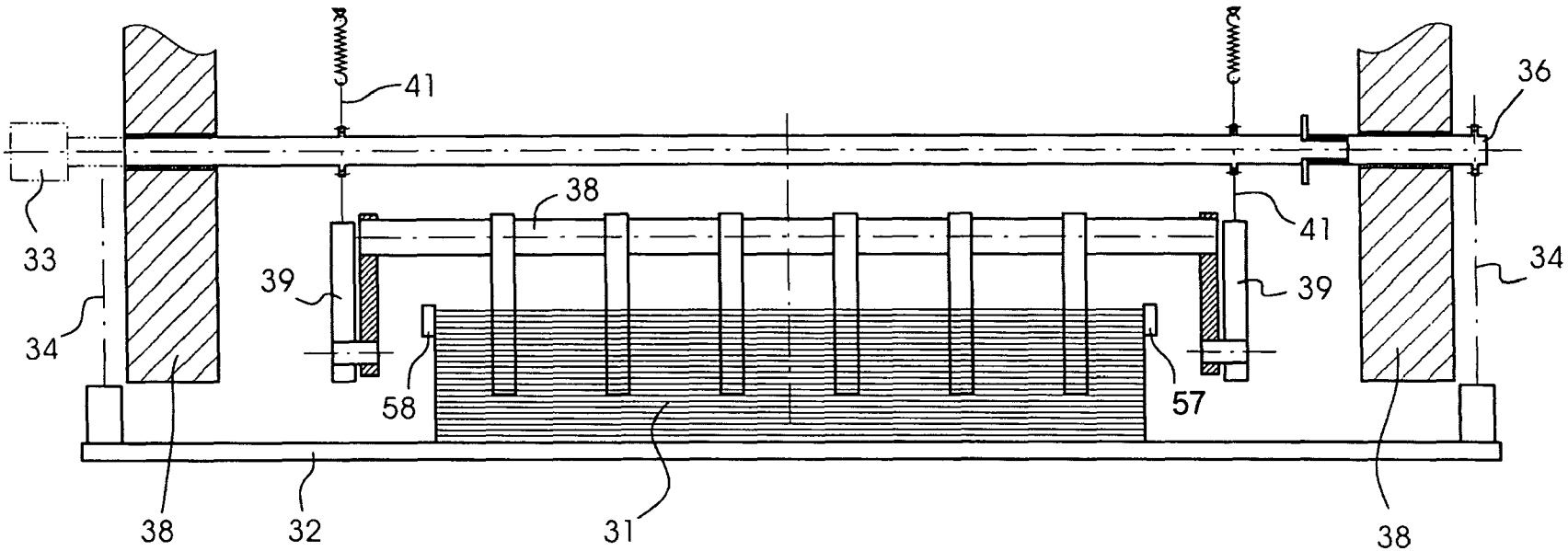
FIG. 3 is a rear view of the sheet stack with coupling of main stack and proof sheet removal apparatus.
Figure 4:
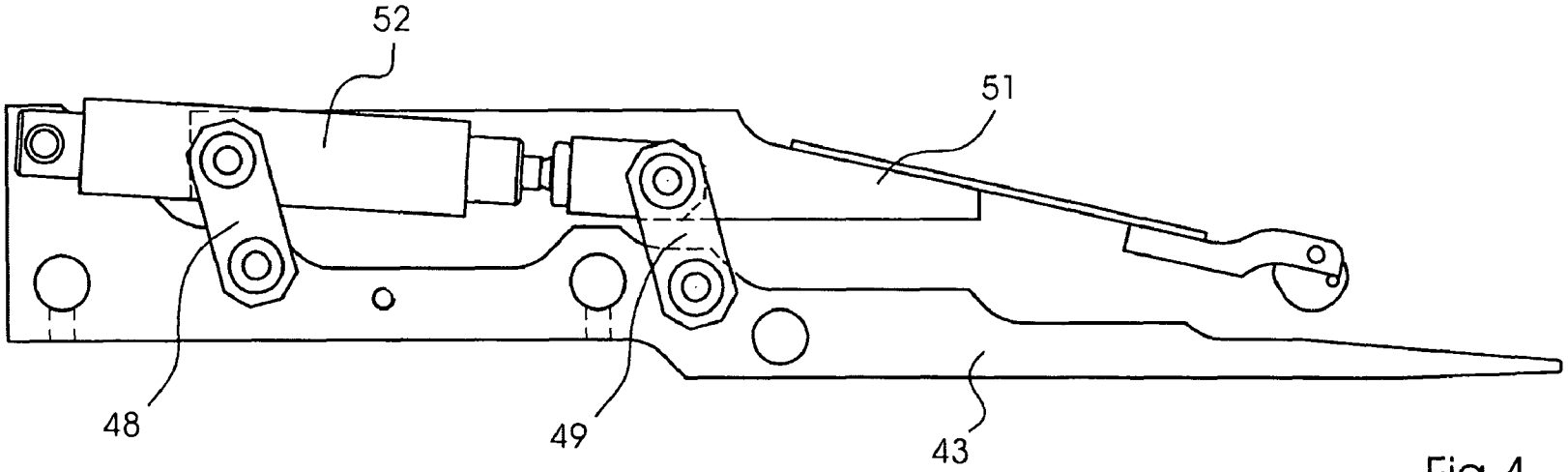
FIG. 4 shows the sheet catcher according to the invention with a gripper device in the opened position.
Figure 5:
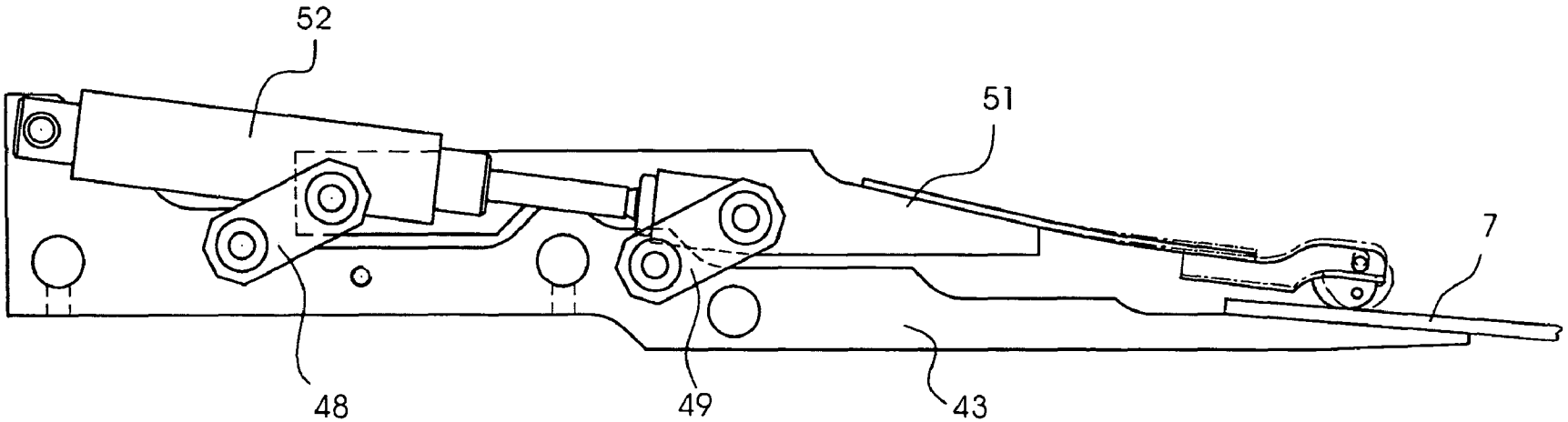
FIG. 5 shows the sheet catcher according to the invention with the gripper device in the closed position.

FIG. 2 shows a proof sheet removal system 37 which, as seen in the sheet transport direction of the machine, is arranged after the deposit stack 31. The proof sheet removal system 37 has a crossmember 38 arranged to be stationary, on which there is mounted a supporting frame 39 that can be lowered by means of chains 41.

The supporting frame 39 supports a front edge stop 42, also referred to as a front lay 42, arranged such that it can be pivoted to align the sheets 7, which are deposited on the main stack 31.

Furthermore, a first sheet catcher 43 which can be moved into two end positions by means of a working cylinder 44, for example a pneumatic cylinder, is mounted on the supporting frame 39.

A further sheet catcher 46, arranged at a distance above the first sheet catcher 43, is arranged such that it can be moved into two end positions by means of a second working cylinder 47.

On the first sheet catcher 43, a gripper device 51 is mounted such that it can be moved by means of two coupling rods 48, 49 arranged in parallel. The gripper movement is produced by a third working cylinder 52 arranged on the first sheet catcher 43.

Figures 6A, 6B, 6C:
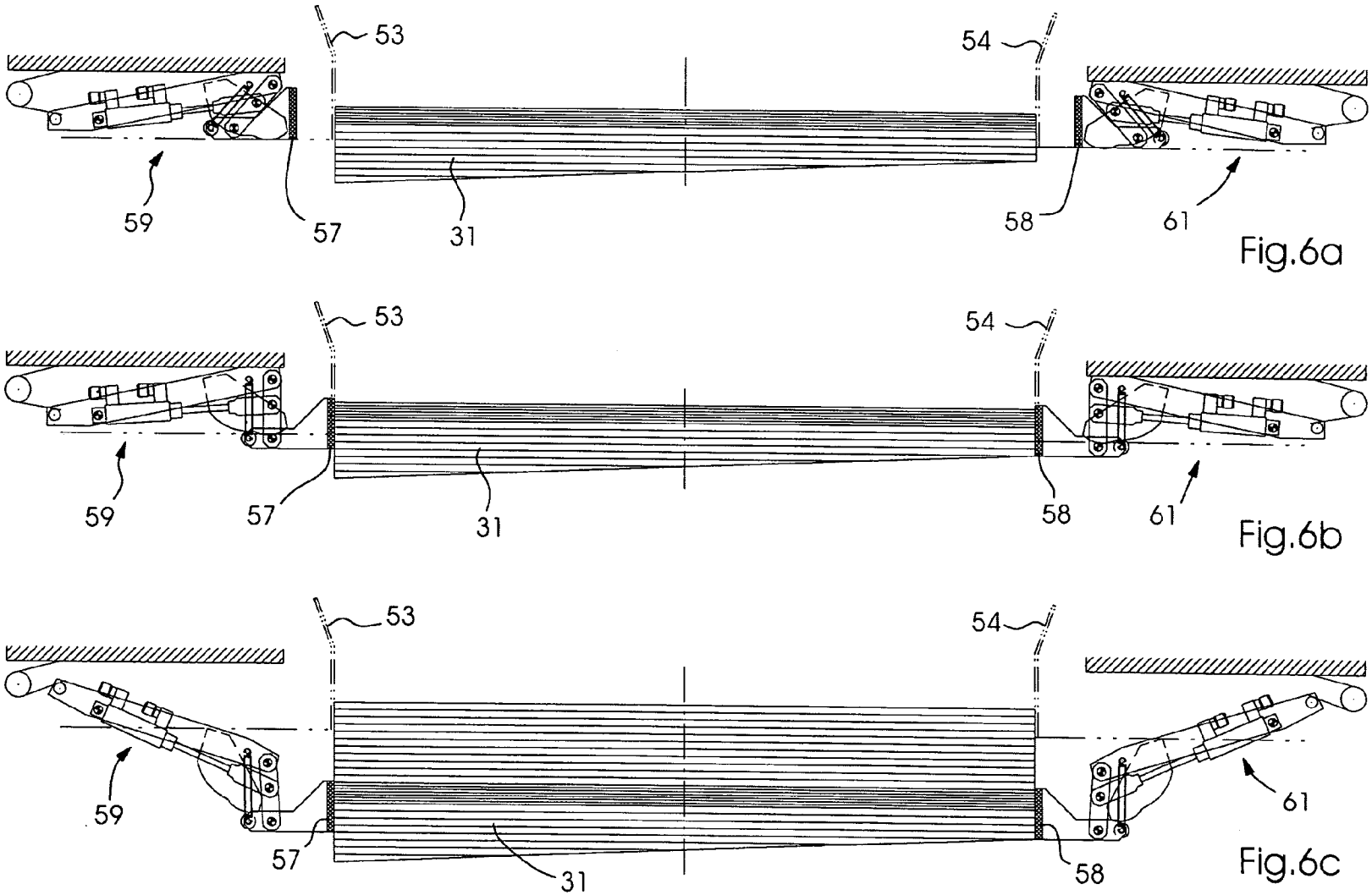
FIGS. 6A-6C show a section through the sheet stack with a view of lateral clamping devices for the upper sheet layers of the sheet stack.

In addition to the front edge stop 42, according to FIGS. 6A-6C the sheet stack 31 has a number of lateral stops 53, 54 and a rear edge stop 56.

Furthermore, a retaining device 57, 58 is provided for the upper sheet layers of the sheet stack 31. This comprises a clamping piece in each case acting laterally on the sheet stack 31 and mounted such that it can be lowered together with the sheet stack 31, in each case by means of a lever mechanism 59, 61 arranged to be stationary.

Figure 7A:
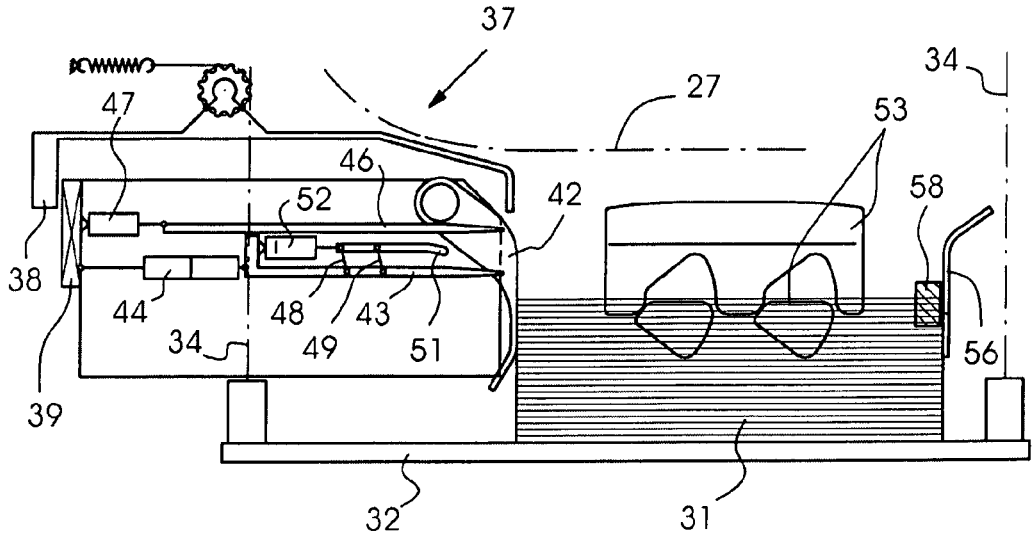
FIGS. 7A-7H show the proof sheet system during the proof sheet removal in different operating positions.
Figure 7B:
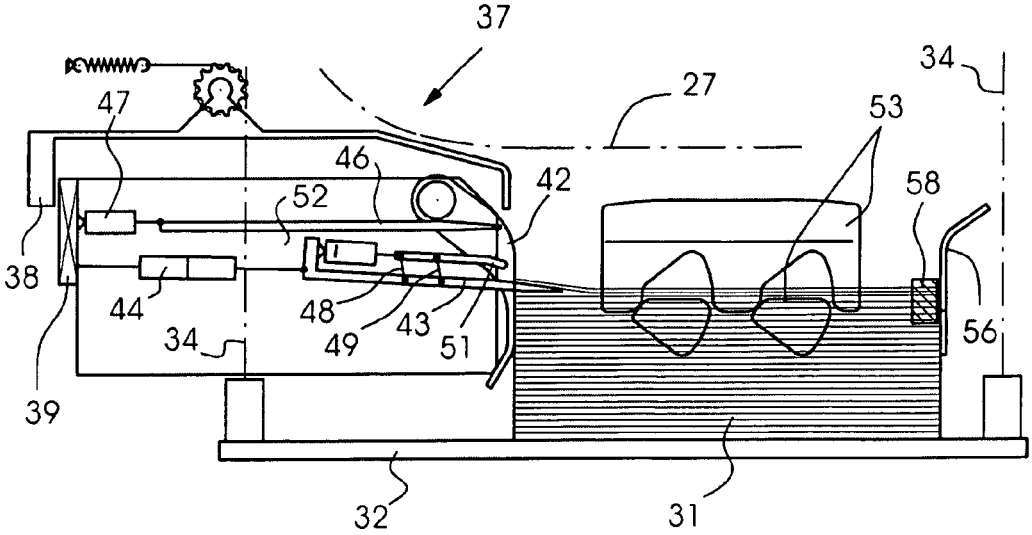

In order to remove a proof sheet or a proof sheet stack from the region of the deposit stack 31, operations are carried out in accordance with FIGS. 7A and 7B. As illustrated in FIG. 7A, the proof sheet system 37 is initially in a waiting position behind the sheet deposit stack 31.

FIG. 7B shows an activation of the lower sheet catcher 43, during which the latter is moved into the deposit region at a small height above the sheet deposit stack 31. The next sheet is then deposited on the lower sheet catcher 43.

Figure 7C:
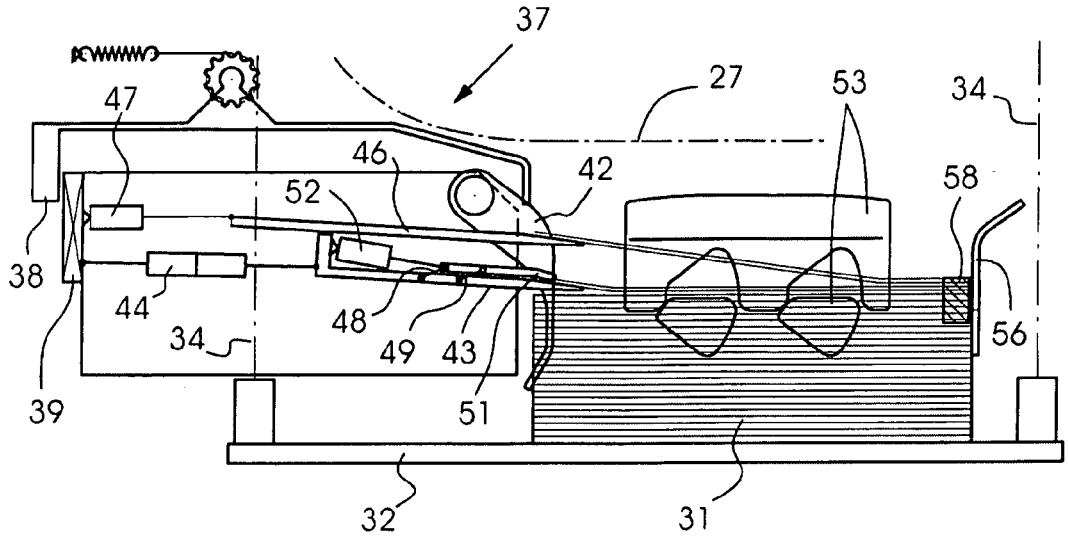

FIG. 7C shows an activation of the gripper device 51, which fixes the proof sheet or proof sheet stack on the lower sheet catcher 43. Extending the upper sheet catcher 46 has the effect of holding back the following sheets, which are supported on the upper sheet catcher 46. The clamping devices 57, 58 are activated and fix the upper sheet layers of the sheet stack 31.

Figure 7D:
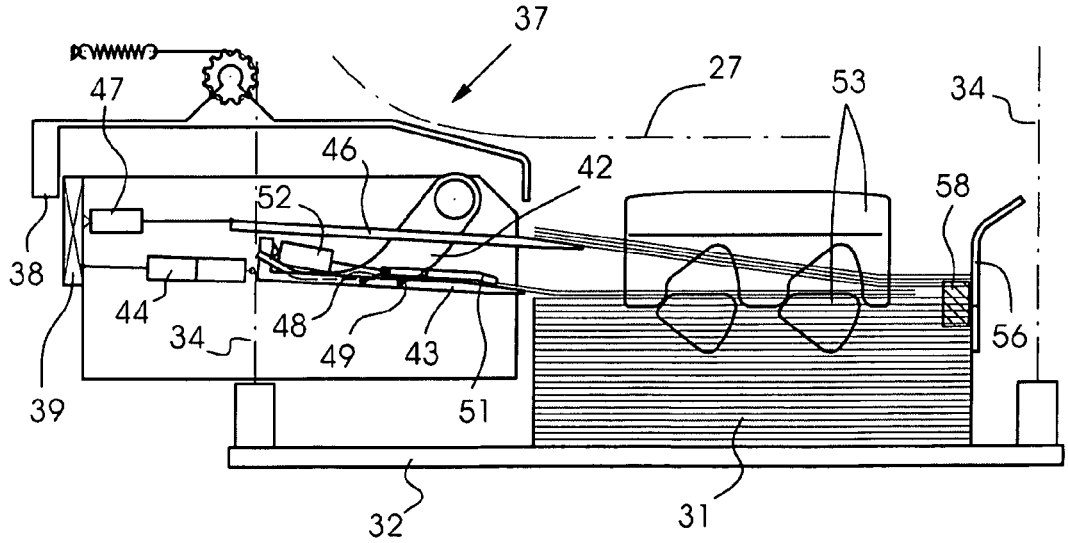

FIG. 7D shows the front edge stop 42 pivoted down and the withdrawal of the proof sheet from the sheet stack 31. During this, the supporting frame 39 together with the sheet catchers 43, 46 is lowered at the cycle rate of the sheet-processing machine.

Figure 7E:
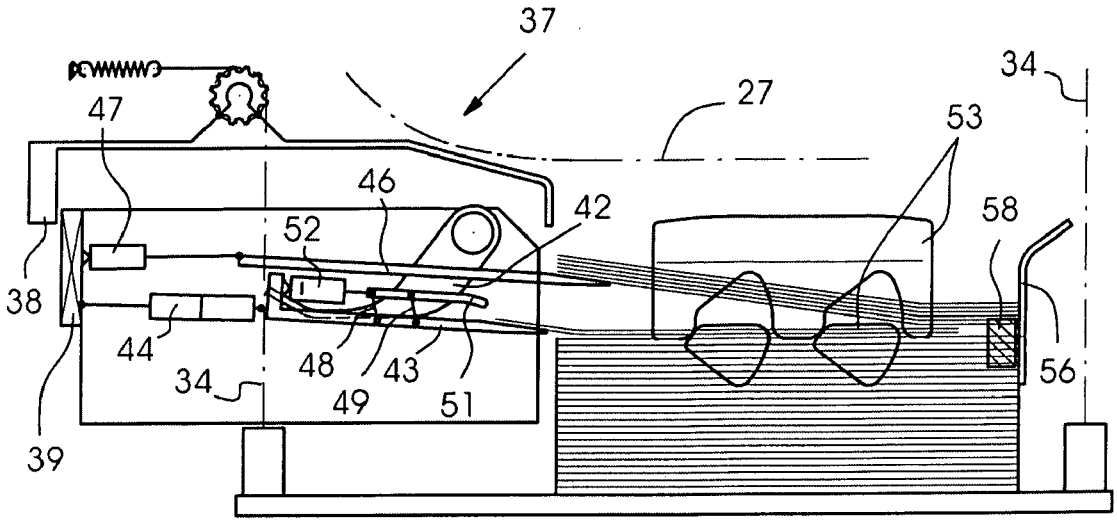
Figure 7F:
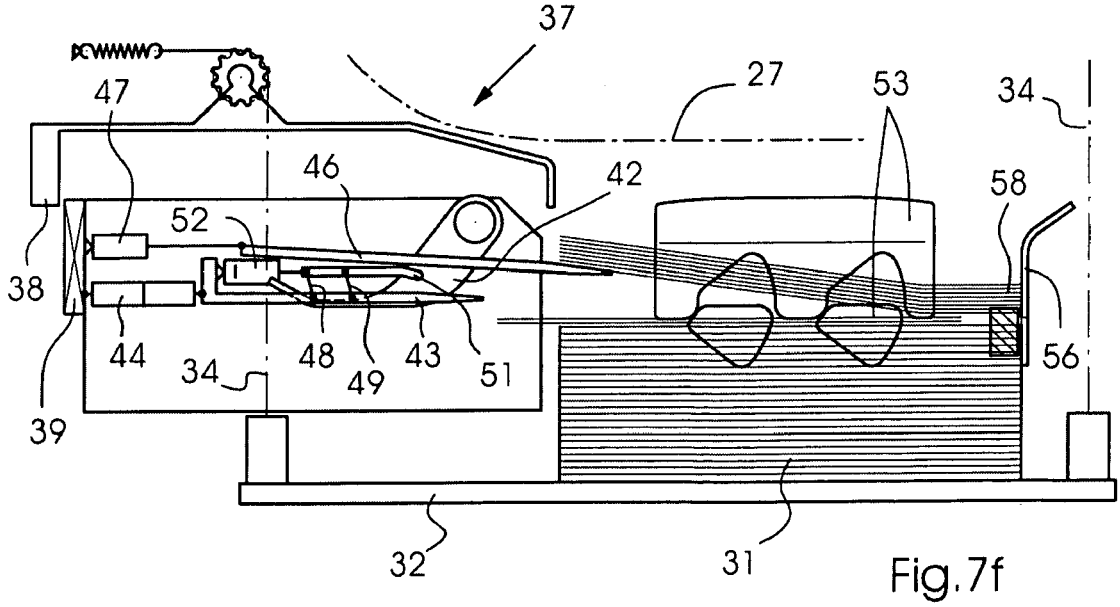
Figure 7G:
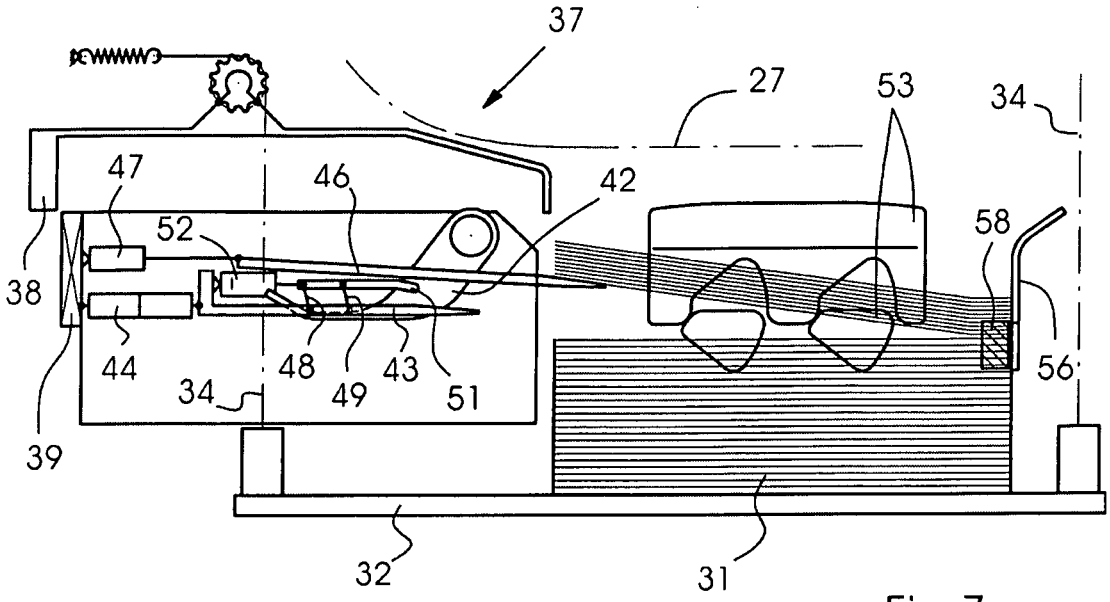
Figure 7H:
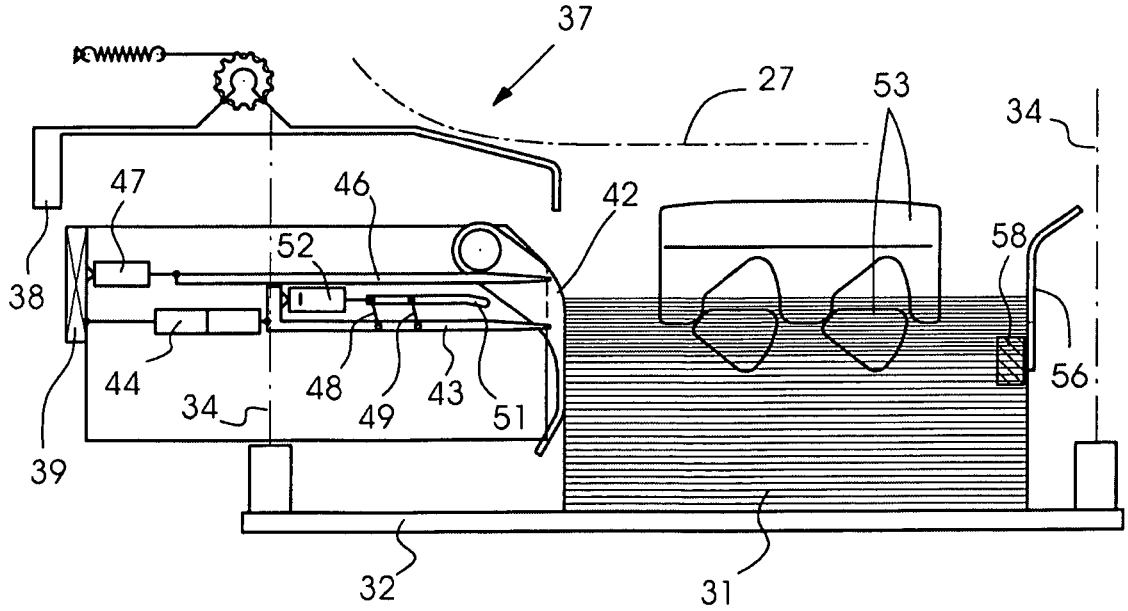

FIG. 7E shows the opening of the gripper device 51, and FIG. 7F shows the release of the front edge of the proof sheet or proof sheet stack. The proof sheet can now be removed, while the upper sheet catcher 46 holds back the following sheets, according to FIG. 7G.

The stack clamps 57, 58 are now released and moved apart, and the upper sheet catcher 46 is pulled back into its waiting position. The front edge stop 42 is pivoted back into the aligning position and the sheets held back are combined with the sheet stack 31.

The invention claimed is:

1. A method of removing at least one proof sheet from a stacking region of a sheet stack in a sheet-processing machine, the method which comprises:

providing a proof sheet removal system with two mutually spaced-apart sheet catchers including a lower sheet catcher and an upper sheet catcher;

moving the lower sheet catcher forward into the stacking region above the sheet stack by an actuator;

following a deposition of at least one proof sheet, fixing the proof sheet with a gripper device, and holding back following sheets by moving in the upper sheet catcher by an actuator; and drawing the at least one sheet out of the stacking region by moving the lower sheet catcher and the gripper device back.

2. The method according to claim 1, which comprises fixing the sheet stack is fixed by way of lateral stack clamps during the proof sheet removal.

3. The method according to claim 1, which comprises, during the proof sheet removal, lowering the proof sheet removal system at a cycle rate of the sheet-processing machine.

4. An apparatus for removing at least one proof sheet from a stacking region of a sheet stack in a sheet-processing machine, comprising:

a proof sheet removal system having two mutually spaced-apart sheet catchers, said proof sheet removal system being movably disposed for vertical movement at a cycle rate of the sheet-processing machine; and one of said sheet catchers having a gripper device.

5. The apparatus according to claim 4, which comprises an actuator for opening and closing said gripper device.

6. The apparatus according to claim 4, wherein each of said sheet catchers has an actuator for moving said sheet catchers from a waiting position into a proof sheet removal position.

7. The apparatus according to claim 4, wherein said proof sheet removal system is coupled to a sheet stack lifting device of the sheet-processing machine.

8. The apparatus according to claim 4, which comprises a sheet stack clamping device for fixing upper sheet layers of the sheet stack.

9. The apparatus according to claim 8, wherein said sheet stack clamping device includes a lever mechanism configured for lowering together with the sheet stack.

10. The apparatus according to claim 4, wherein said proof sheet removal system is configured for removing proof sheets from a printing press.

11. An apparatus for removing at least one proof sheet from a stacking region of a sheet stack in a sheet-processing machine, comprising:

a proof sheet removal system having a first sheet catcher and a second sheet catcher spaced apart from said first sheet catcher, said proof sheet removal system being movably disposed for vertical movement at a cycle rate of the sheet-processing machine; and said first sheet catcher having a gripper device for fixing the at least one proof sheet on said first sheet catcher.

* * * * *